US008387262B2

(12) United States Patent
Petzl et al.

(10) Patent No.: US 8,387,262 B2
(45) Date of Patent: Mar. 5, 2013

(54) ICE AXE SHAFT EQUIPPED WITH A GRIP WITH A DOUBLE INTERMEDIATE GRIPPING BRACE

(75) Inventors: Paul Petzl, Barraux (FR); Jon Rockfeller, Meylan (FR)

(73) Assignee: Zedel, Crolles (FR)

( * ) Notice: Subject to any disclaimer, the term of this patent is extended or adjusted under 35 U.S.C. 154(b) by 175 days.

(21) Appl. No.: 12/831,754

(22) Filed: Jul. 7, 2010

(65) Prior Publication Data

US 2011/0016732 A1 Jan. 27, 2011

(30) Foreign Application Priority Data

Jul. 22, 2009 (FR) ..... 09 03618

(51) Int. Cl.
*B26B 23/00* (2006.01)

(52) U.S. Cl. ..... 30/308.1; 30/340; 30/312

(58) Field of Classification Search ..... 30/308.1–308.3, 30/340, 312
See application file for complete search history.

(56) References Cited

U.S. PATENT DOCUMENTS

| | | | | |
|---|---|---|---|---|
| 4,087,086 | A * | 5/1978 | McGrath et al. | 269/212 |
| 7,225,544 | B2 | 6/2007 | Petzl | |
| 2005/0028387 | A1 | 2/2005 | Skrivan et al. | |
| 2005/0108881 | A1 | 5/2005 | Petzl | |
| 2006/0070248 | A1 | 4/2006 | Skrivan et al. | |
| 2008/0085150 | A1 | 4/2008 | Wang | |

FOREIGN PATENT DOCUMENTS

| | | |
|---|---|---|
| EP | 1 533 006 A1 | 5/2005 |
| FR | 2 918 898 | 1/2009 |
| WO | WO 01/70466 A1 | 9/2001 |

OTHER PUBLICATIONS

Mar. 11, 2010 Search Report issued in French Patent Application No. FR 0903618 (with translation).

* cited by examiner

*Primary Examiner* — Phong Nguyen
(74) *Attorney, Agent, or Firm* — Oliff & Berridge, PLC

(57) ABSTRACT

An ice axe gripping shaft comprises a grip made of plastic equipped with a bottom stop for the hand to press on, located opposite an intermediate brace. An auxiliary lever articulated on the intermediate brace comprises a locking cam and a curved part acting as finger brace in the locked position.

3 Claims, 5 Drawing Sheets

ICE AXE SHAFT EQUIPPED WITH A GRIP WITH A DOUBLE INTERMEDIATE GRIPPING BRACE

BACKGROUND OF THE INVENTION

The invention relates to an ice axe gripping shaft comprising:

- a grip made of plastic material equipped with a stop for the hand to press against located opposite from an intermediate brace,
- and means for adjusting the intermediate brace along the shaft.

STATE OF THE ART

The way the shaft of an ice axe is held in the alpinist's hand constitutes an essential factor for efficiency of penetration of the axe head into the ice. The alpinist generally holds the end of the shaft so as to obtain the greatest striking moment to achieve an optimum penetration force of the axe head into the ice. Such an ice axe is generally used as a traction pick devoid of an attachment strap for extreme climbing, ice cascades and competition. Ice axe shafts have already been proposed that enable the position of the bottom pressing stop to be adjusted to the morphology of the user's hand.

The document EP1533006 describes a bottom pressing stop with an adjustment end-piece mounted swivelling on the gripping shaft. The intermediate brace that is located opposite is formed by a protuberance that is fixed and not adjustable.

The document US 2006/0070248 provides a telescopic adjustment shaft by adding a certain number of spacers modifying the length of the grip.

Opposite this bottom stop, it is also known to adjust the intermediate brace along the shaft between a bottom position and a top position. The brace simply has to be loosened to obtain a certain radial clearance, and the brace then be slid to a given position along the shaft and then re-secured in this position. Performing such an adjustment on site by means of a fixing nut and bolt system takes a long time, requires the use of tools, and does not enable positive locking of the intermediate brace to be achieved if the nut is insufficiently tightened.

In the document FR 2918898, a lever with a cam is used for adjusting the intermediate brace of the ice axe, the lever being located diametrically opposite with respect to the intermediate brace. The shaft does not have a plastic grip nor does it have a bottom pressing stop.

OBJECT OF THE INVENTION

The object of the invention consists in providing an ice axe shaft having a gripping handle with improved hold and that is easy to adjust without requiring any tools.

The ice axe shaft according to the invention is characterized in that the intermediate brace is provided with a swivelling auxiliary lever comprising:

- an arcuate part forming a finger brace,
- and a cam for blocking and unblocking the intermediate brace and the finger brace in a predefined position along the shaft.

Adjustment of the double intermediate brace is very quick and can be performed by the alpinist at any time on the site without the need for tools. The auxiliary lever simply has to be moved to the unlocked position, the double intermediate brace be slid to the required position, and the lever then be re-secured in the locked position.

The first intermediate brace acts as brace for changing hands at the top part and collaborates directly at the bottom part with the second finger brace of the auxiliary blocking and unblocking lever.

According to a preferred embodiment, the auxiliary lever is inserted between two adjacent fingers of the intermediate brace and is mounted swivelling on a spindle acting as assembly means of said fingers.

According to a preferred embodiment, the ice axe shaft is equipped with a series of adjustment notches staggered at regular intervals in the heightwise direction to form a rack that determines a first positioning area in engagement with the notches. The shaft has a smooth part, above the first positioning area, forming a second positioning area outside the notches of the grip.

BRIEF DESCRIPTION OF THE DRAWINGS

Other advantages and features will become more clearly apparent from the following description of a particular embodiment of the invention given for non-restrictive example purposes only and represented in the accompanying drawings, in which.

DETAILED DESCRIPTION OF THE INVENTION

Figure 1:
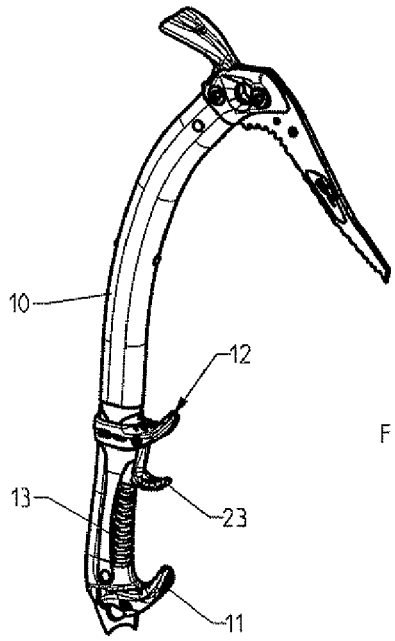
FIG. 1 is a perspective view of an ice axe having a grip equipped with an adjustable double intermediate brace according to the invention.
Figure 2:
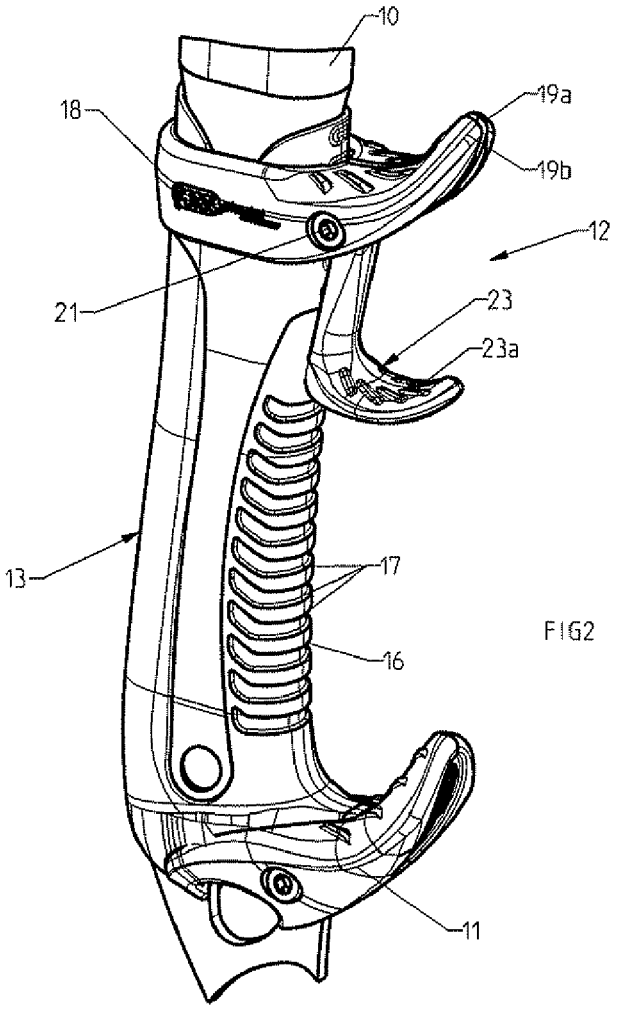
FIG. 2 shows an enlarged scale perspective view of the grip of FIG. 1.
Figure 3:
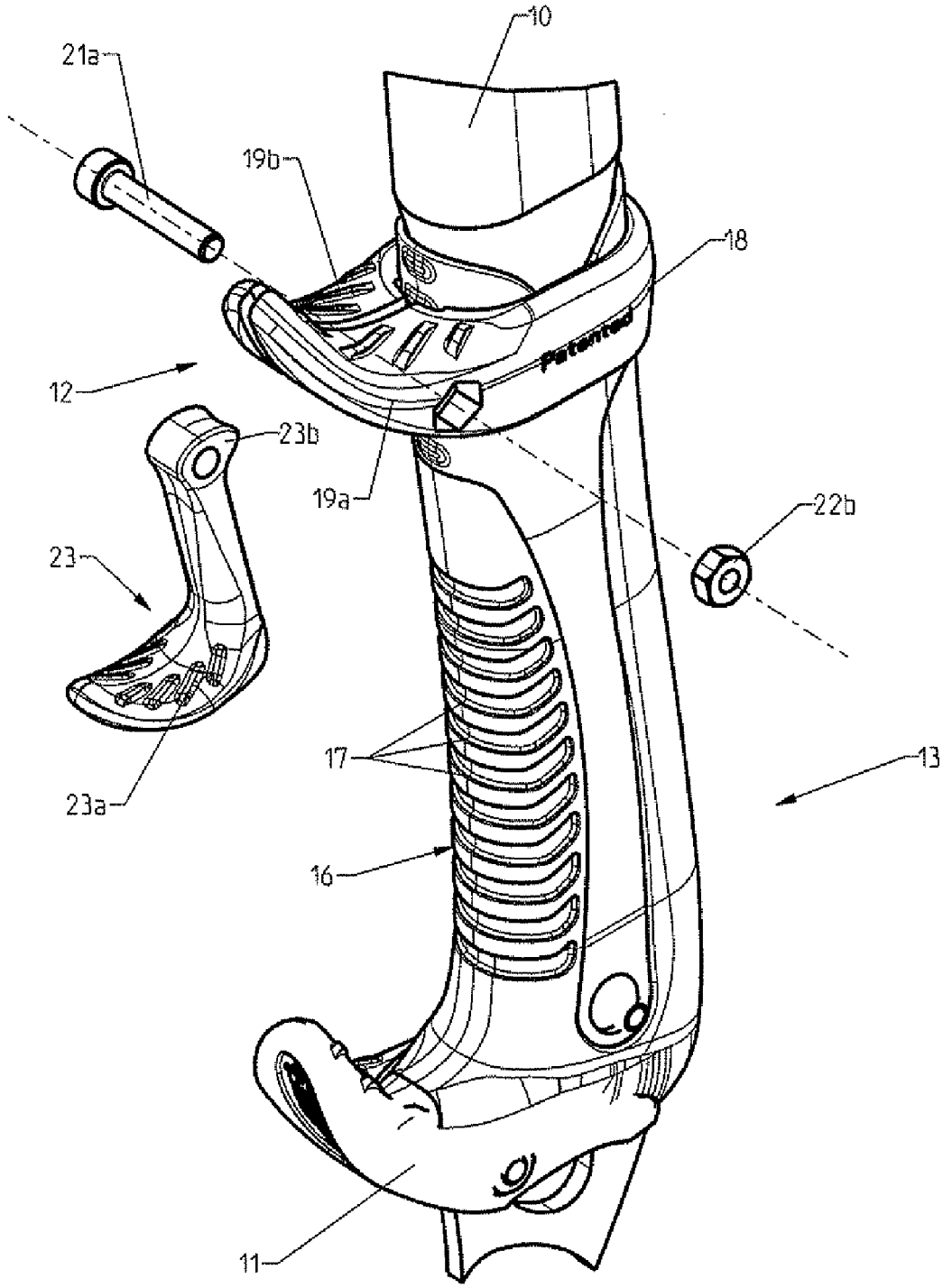
FIG. 3 is an exploded perspective view of the grip of FIG. 2 after the auxiliary lever serving the purpose of finger brace has been disassembled.

With reference to FIGS. 1 to 6, a gripping shaft 10 of an ice axe comprises a grip 13 equipped with a bottom stop 11 for the hand to press against and an intermediate brace 12 for the user to change hands. Such an ice axe is generally used as a traction pick devoid of an attachment strap for extreme climbing, ice cascades and competition.

Shaft 10 is preferably made from aluminium alloy and grip 13 at the base of shaft 10 is made from plastic. It is bounded by bottom pressing stop 11 and intermediate brace 12 to protect most of the user's gloved hand against shocks against the ice. Grip 13 can be overmolded onto the end of shaft 10 or be assembled onto the latter by any other assembly method.

The slant of pressing stop 11 is advantageously adjustable at the bottom end of grip 13. Adjustment of the slant of stop 11 can be performed by any other means for locking in position as described in the document EP1533006 filed by the applicant.

Between stop 11 and intermediate brace 12, grip 13 presents an ergonomic curved part 16 corresponding to the gripping area. It is provided with a plurality of ribs 17 for enhanced gripping and adherence of the hand.

Intermediate brace 12 is in the form of an openable grip comprising a body 18 extended by two adjacent fingers 19*a*, 19*b*. Body 18 is made from plastic deformable by elasticity to enable it to be fitted along an intermediate portion 10*a* of shaft 10. This intermediate portion 10*a* is located above curved part 16 and determines a first positioning area ZP1 of intermediate brace 12. The two fingers 19*a*, 19*b* are positioned close to one another to form a single bearing surface salient with respect to shaft 10 and having a slight curve in the upward direction. An assembly means 21 with a bolt 21*a* and nut 21*b* passes through aligned holes of the two fingers 19*a*, 19*b* to keep the latter in the position close to one another.

Figure 4:
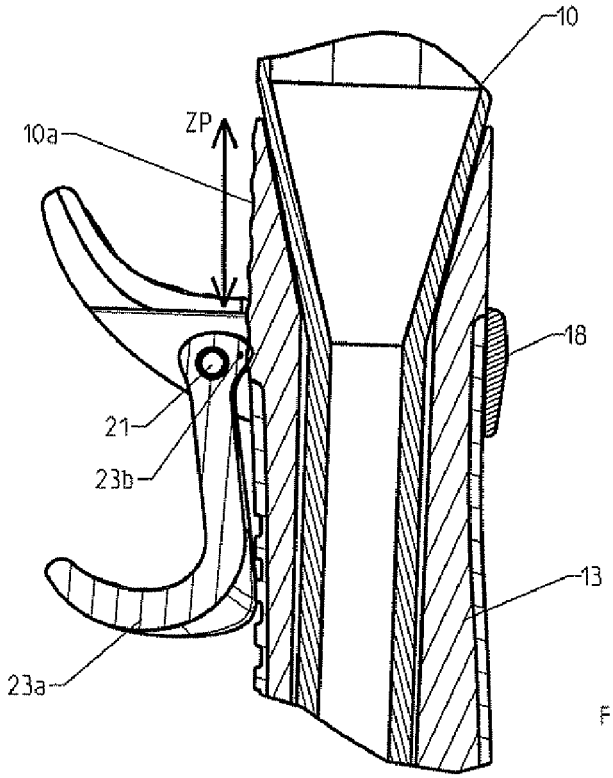
FIG. 4 is a partial vertical cross-sectional view of the grip, the auxiliary lever serving the purpose of finger brace being locked in a first adjustment position of the intermediate brace along the shaft.
Figure 5:
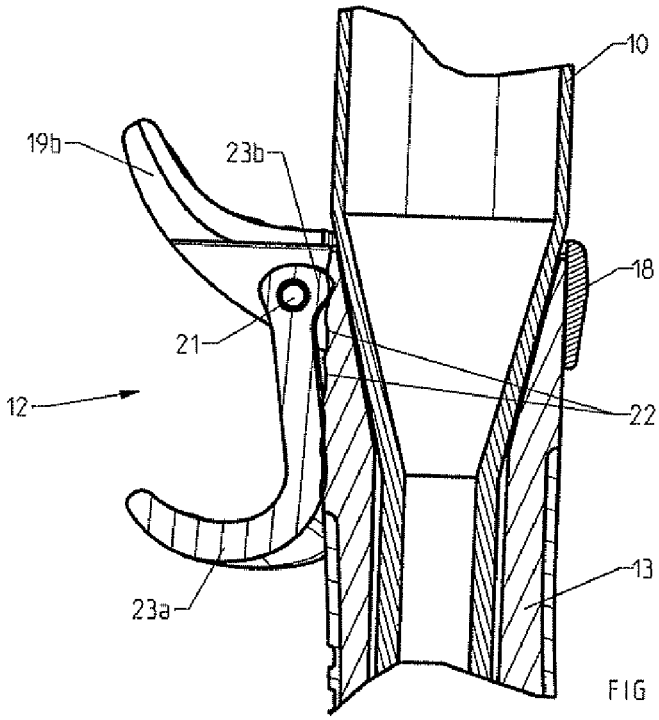
FIG. 5 shows an identical view to FIG. 4 when the auxiliary lever is locked in a second adjustment position of the intermediate brace along the shaft.

Straight intermediate portion 10*a* of shaft 10 is equipped with a series of adjustment notches 22 staggered at regular intervals in the heightwise direction to form a rack arranged above ribs 17. This rack determines first positioning area ZP1 in engagement with notches 22. An auxiliary lever 23 is mounted swivelling between the two fingers 19*a*, 19*b* and is provided with a locking cam 23*b* designed to operate in conjunction with one of notches 22 of the rack according to the required adjustment along first positioning area ZP1. The swivelling axis of auxiliary lever 23 is advantageously formed by bolt 21*a*. Auxiliary lever 23 can be operated manually between an unlocked position (FIG. 6) and a locked position (FIGS. 4 and 5).

Auxiliary lever 23 advantageously presents a curved part 23*a* raised upwards to form a finger brace in the locked position.

The assembly of parts formed by intermediate brace 12 and auxiliary lever 23 thereby fulfils a twofold function of both brace for changing hands and finger brace. The latter is placed underneath the intermediate brace and on the same side.

Figure 6:
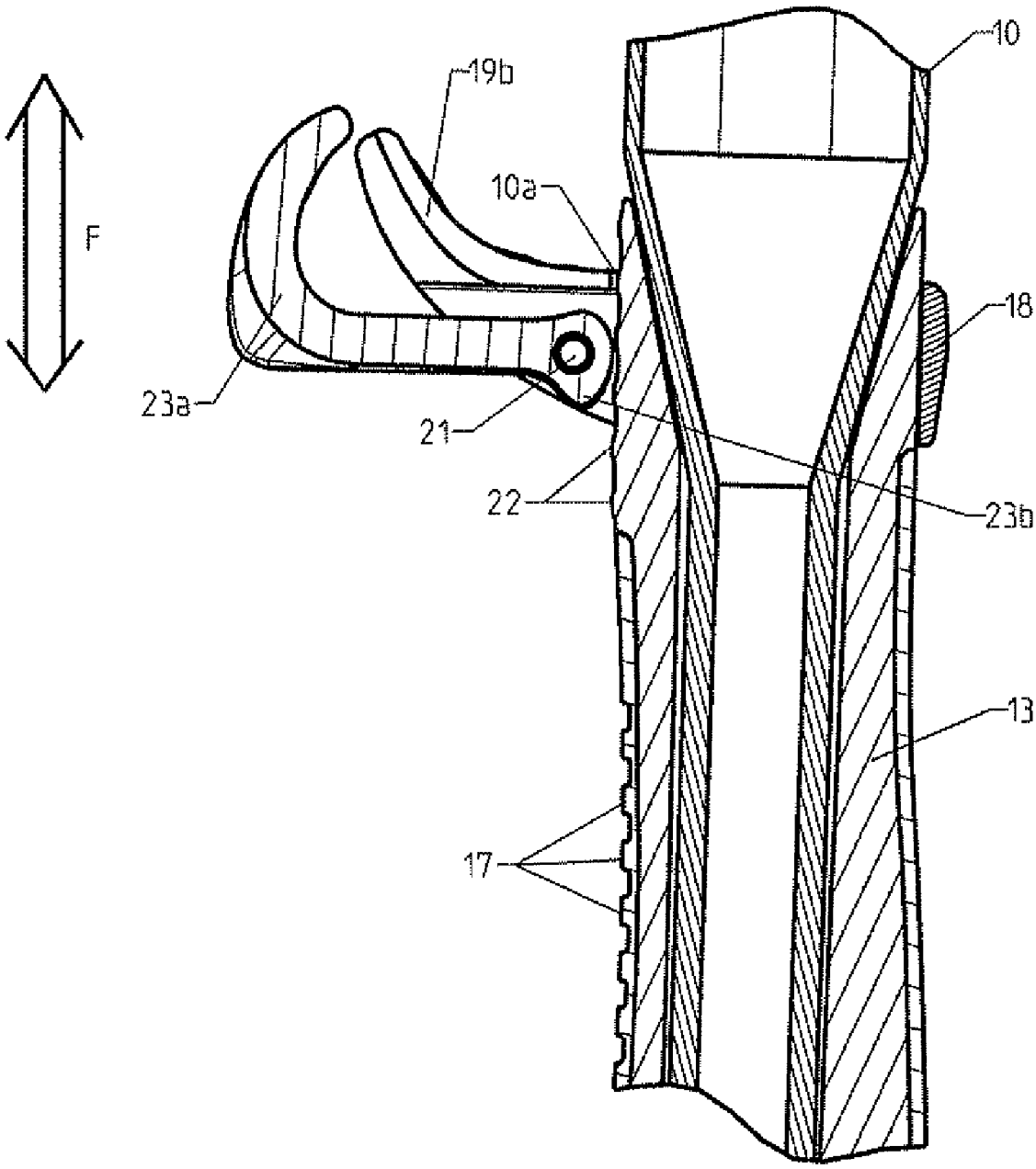
FIG. 6 represents an identical view to FIG. 4 when the auxiliary lever is unlocked to perform adjustment.

In the locked position illustrated in FIG. 6, auxiliary lever 23 is raised to release cam 23*b* from notches 22 of the rack. The intermediate assembly formed by brace 12 and finger brace forms a double brace that is able to slide (see arrow F) simultaneously along first positioning area ZP1 of shaft 10*a* to perform adjustment.

Auxiliary lever 23 then simply has to be pivoted to the locked position to secure intermediate brace 12 and the finger brace in the required adjustment position following engagement of cam 23*b* of auxiliary lever 23 in one of notches 22 of the rack.

FIG. 4 shows finger brace lever 23 locked in a bottom notch 22 of first positioning area ZP1 of shaft 10*a*.

In FIG. 5, finger brace lever 23 is locked in a top notch 22 of first positioning area ZP1 of shaft 10*a*.

Figure 7:
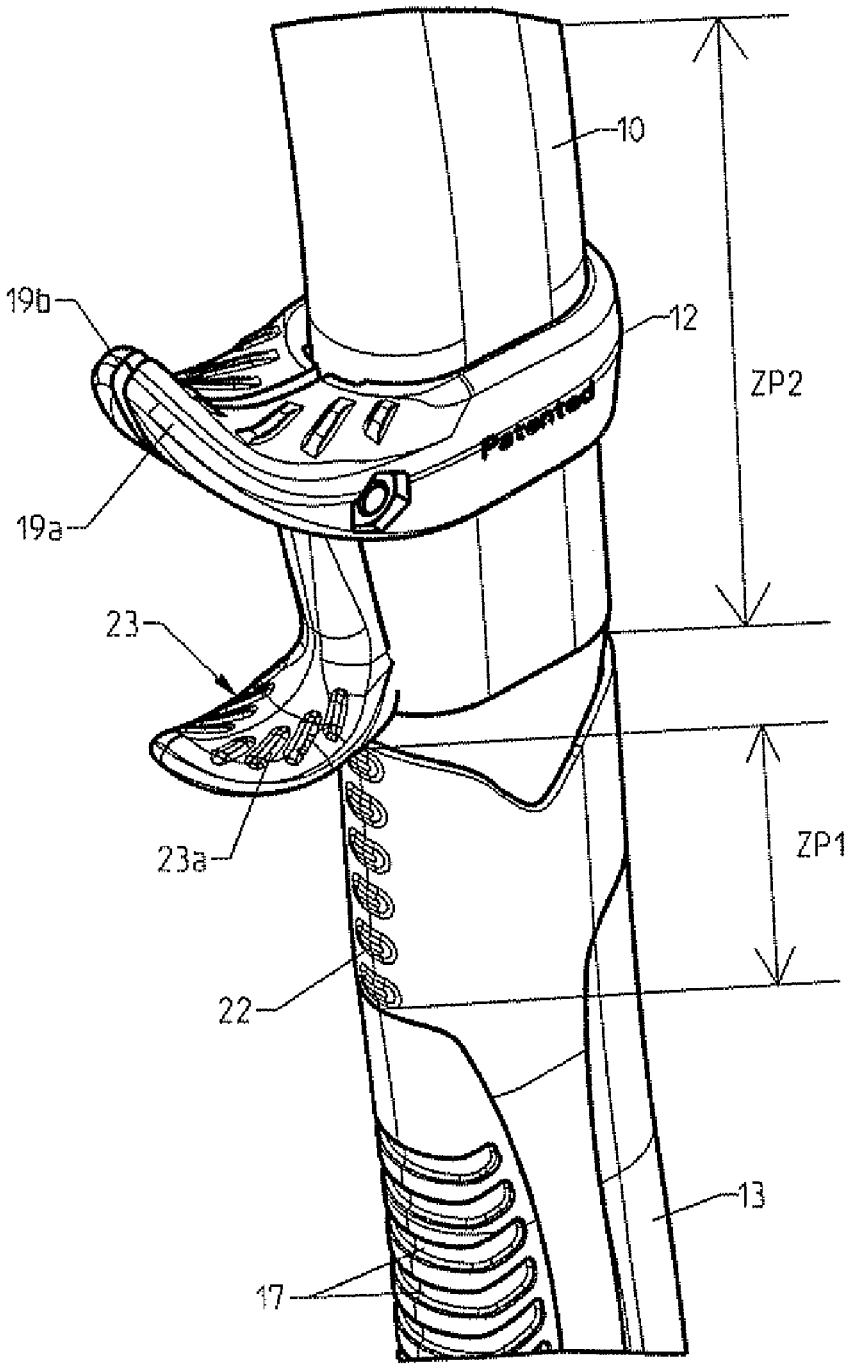
FIG. 7 is a partial vertical cross-sectional view of the grip, the auxiliary lever serving the purpose of finger brace being locked in a third adjustment position situated on the smooth part of the shaft outside the notches.

In FIG. 7, intermediate brace 12 and finger brace lever 23 are adjustable on a smooth part of shaft 10. This adjustment is possible along a second positioning area ZP2 outside notches 22. Locking is achieved by direct jamming of cam 23*b* on metal shaft 10 when auxiliary lever 23 is lowered to the locked position.

The invention claimed is:

1. Ice axe gripping shaft comprising:

an axe head disposed at one end of the gripping shaft;

a grip made of plastic material bounded by a stop at an end of the grip for a hand to press against, the grip disposed at an opposite end of the gripping shaft;

an intermediate brace comprising:

a collar body substantially encompassing the grip and having two ends; two arcuate fingers extending laterally from the two ends of the collar body;

an auxiliary lever comprising:

a first portion extending substantially parallel to the grip;

an arcuate part forming a finger brace, the arcuate part extending laterally from an end of the first portion and outwardly with respect to the grip;

a cam disposed at an opposite end of the first portion for locking and unlocking the intermediate brace at a predefined position along the gripping shaft.

wherein the cam is positioned between the two arcuate fingers of the intermediate brace and is mounted swiveling on a bolt extending through the two arcuate fingers;

wherein the gripping shaft has a series of adjustment notches staggered at regular intervals in a heightwise direction to form a rack that defines a first positioning area, and wherein the cam of the auxiliary lever engages with one of the adjustment notches for locking the intermediate brace at the predefined position along the gripping shaft.

2. Ice axe gripping shaft according to claim 1, wherein the intermediate brace acts as a brace for changing hands at the top part of the intermediate brace.

3. Ice axe gripping shaft according to claim 1, wherein the gripping shaft comprises a smooth part to form a second positioning area outside the notches, and situated above the first positioning area.

* * * * *